US005188034A

United States Patent [19]

Iaccino et al.

[11] Patent Number: 5,188,034

[45] Date of Patent: Feb. 23, 1993

[54] SHIRT PALLET WITH RETRACTABLE ARMS BIASED TOWARD EXTENDED POSITION

[75] Inventors: Alex Iaccino, Mount Prospect; Phil Motev, Deerfield; Rick L. Fuqua, Chicago, all of Ill.

[73] Assignee: Advance Process Supply Company, Chicago, Ill.

[21] Appl. No.: 773,321

[22] Filed: Oct. 9, 1991

Related U.S. Application Data

[63] Continuation-in-part of Ser. No. 746,652, Aug. 16, 1991.

[51] Int. Cl.[5] ..... B41F 15/18

[52] U.S. Cl. ..... 101/474; 101/126

[58] Field of Search ..... 101/115, 126, 474; 38/135

[56] References Cited

U.S. PATENT DOCUMENTS 3,427,964 2/1969 Vasilantone ..... 101/126 X 4,287,826 9/1981 Brabec ..... 101/115

5,016,367 5/1991 Breen et al. ..... 38/135

*Primary Examiner*—Clifford D. Crowder

*Attorney, Agent, or Firm*—Fitch, Even, Tabin & Flannery

[57] ABSTRACT

A pallet for supporting shirts for printing over the entire surface of the shirt, particularly including the sleeves. A shirt is telescoped over a thin upper panel whereafter separate sleeve panels mounted to the upper panel are slid outward into the sleeves of the shirt to provide support thereto. The sleeve panels may be provided with means for moving to their extended position automatically. With the sleeve panels still maintained outward, the upper panel is then lowered down into abutment with the lower panel to secure the shirt between the upper and lower panels. Lowering of the upper panel with the sleeve panels mounted thereto causes the sleeve panels to be raised so that the pallet forms a generally planar overall surface upon which the shirt is supported and maintained in a stationary position during printing.

5 Claims, 9 Drawing Sheets

FIG. 1
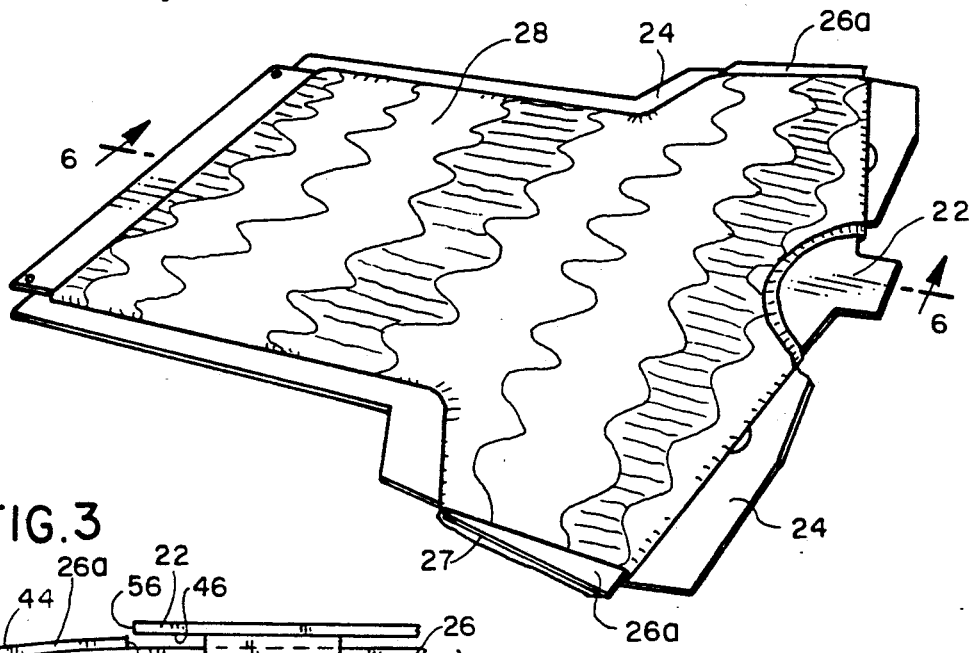
FIG. 3
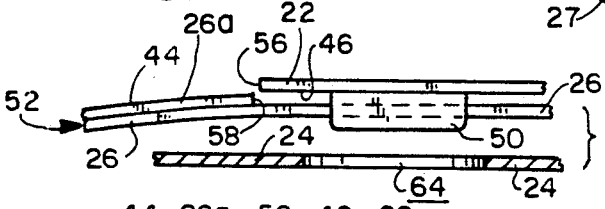
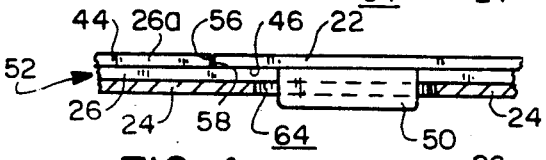
FIG. 4
FIG. 2
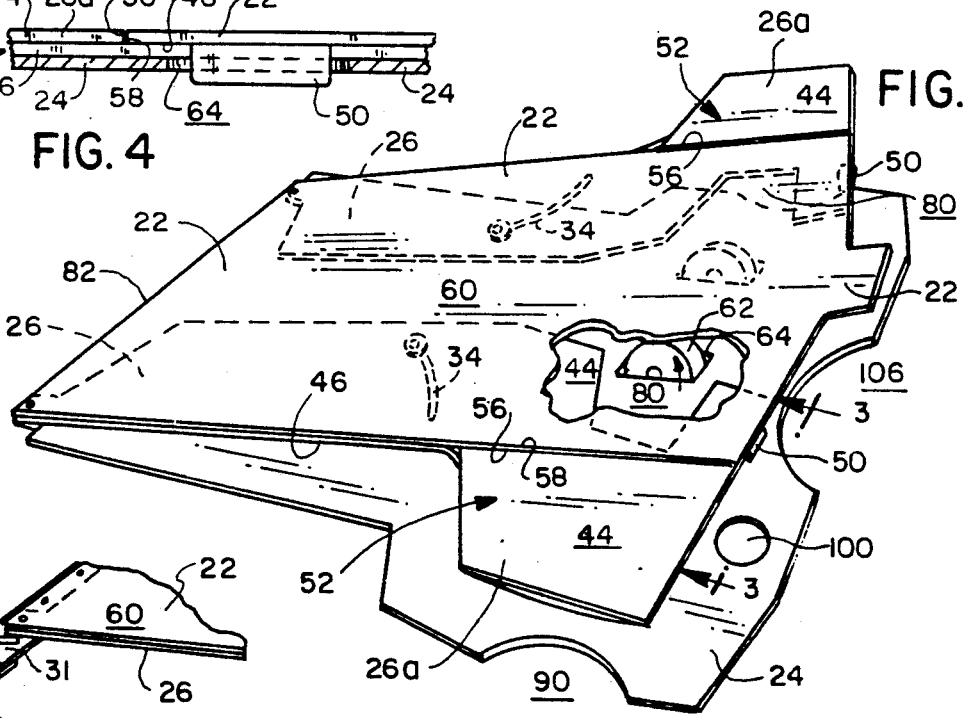
FIG. 5

FIG. 6
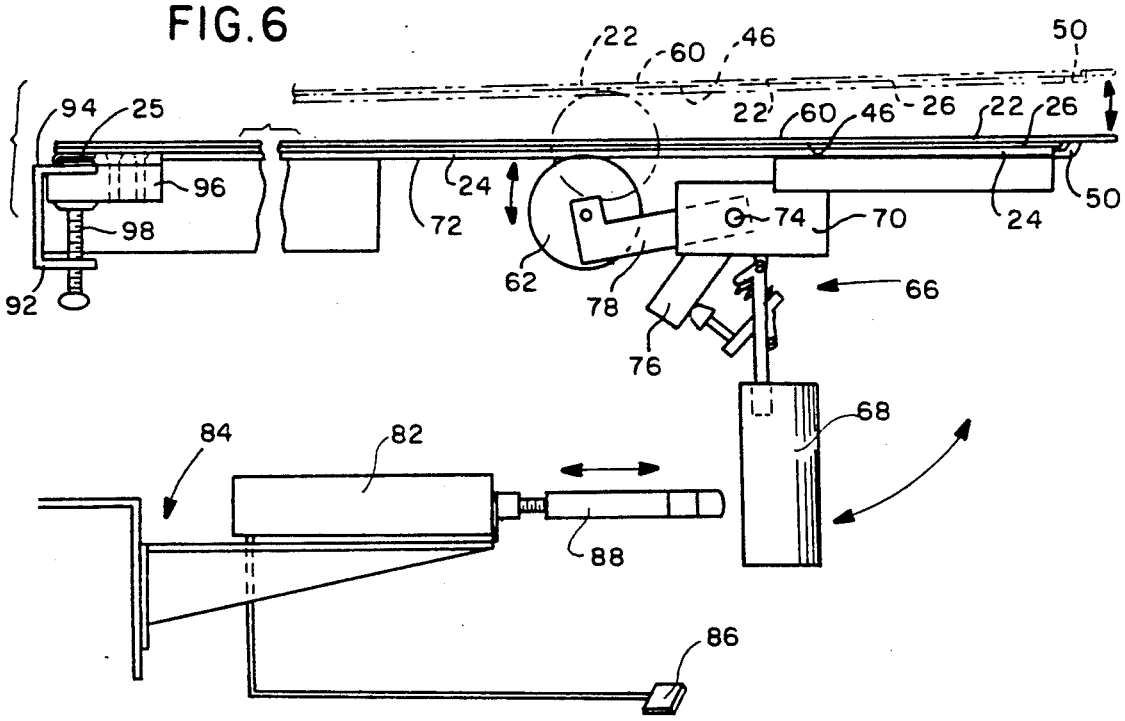
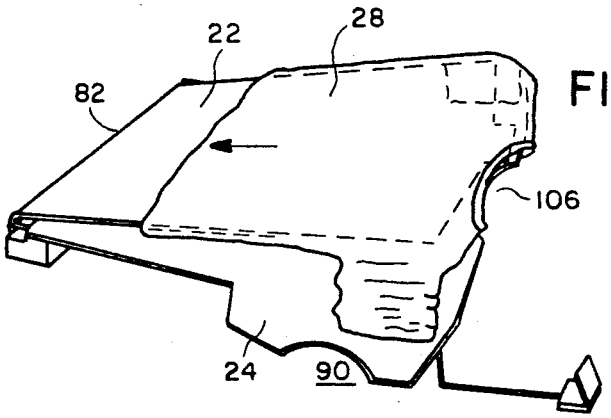
FIG. 7
FIG. 8
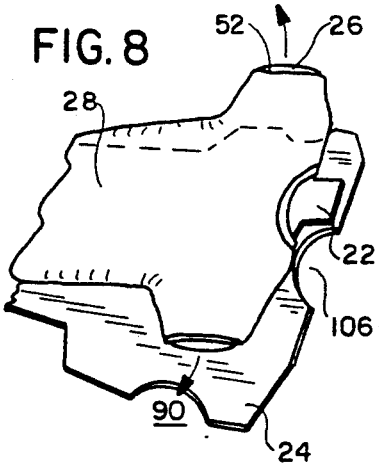
FIG. 9
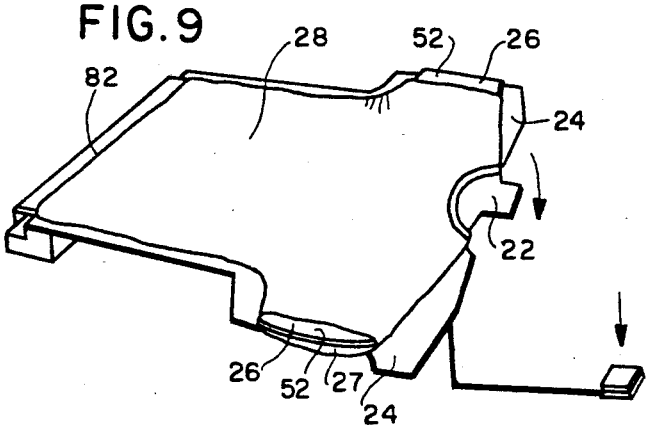

SHIRT PALLET WITH RETRACTABLE ARMS BIASED TOWARD EXTENDED POSITION

CROSS-REFERENCES TO RELATED APPLICATIONS

This is a continuation-in-part of co-pending U.S. patent application Ser. No. 746,652 entitled "Shirt Pallet With Retractable Arms," filed on Aug. 16, 1991.

FIELD OF THE INVENTION

The present invention relates to pallets used to support garments during screen printing, and more particularly, relates to such pallets which allow for printing over an entire side of a shirt, including the arms.

BACKGROUND OF THE INVENTION

Conventional screen printing on garments such as T-shirts was traditionally limited to printing over only a small portion of the middle of the shirt. Accordingly, pallets were designed which supplied the requisite support to the center portion of the shirts during printing and maintained the center portion of the shirts in a stationary position as the shirts and pallets were advanced into successive registration with each of a number of printing stations whereby the composite of the colors printed at each of the stations resulted in production of a multi-colored image on the center portion of the shirt.

Recently, there has been a demand for T-shirts having printing over substantially the entire surface of the shirt, particularly including the sleeves. To accomplish this, belt presses are employed wherein the shirts are laid flat on a conveyor belt which transports the shirts to one or more printing units. Since there is nothing inside the shirts, as there is when utilizing conventional pallets, the shirts lay completely flat, so that prints can be made to extend across the entire side of a shirt front or back with little or no gap at the lateral edges of the shirt, which gaps are unavoidable when utilizing conventional pallets. Thus, the images printed on one side of the shirt can meet the images printed on the other side of the shirt to allow for a continual image extending across the front and back of the shirt. To assure that the print extends completely to the lateral edges of the shirt and particularly to allow print to cover the sleeves, prints are actually made larger than the shirt so that the print extends beyond the outer edges of the shirt. Thus, the print extends not only over the entire side of the shirt including the sleeves, but also extends beyond the edges of the shirt, with the portion of the print extending beyond the shirt edge being applied directly onto the belt upon which the shirt rests.

Belt presses have been found to suffer numerous shortcomings. A principle shortcoming is the high initial purchase cost of belt presses. Another shortcoming is that the belt must be cleaned following each printing before another shirt can be loaded onto the belt. This results not only in additional expense associated with the washing mechanism and/or personnel to carry out the washing, but also imposes a limitation as to the types of inks which can be applied since many types of inks, such as plastisol, are not easily removable from the belt. Additionally, since the print extends beyond the edges of the shirt, there is considerable waste of ink which is printed on the belt only to be later scrubbed off.

A still further shortcoming of belt presses is inaccurate alignment. Since the shirts are not secured upon a pallet, as is the practice with more conventional rotary screen presses, but, rather, merely lay upon the belt, detailed prints are not achievable. That is, even where adhesive spray is applied to the belt, the adhesive will only secure the back side of the shirt in a stationary position on the belt, while the front side of the shirt which is to be printed upon remains free to move around. Thus, even during printing of one color at a single station, design detail is limited due to the freedom of movement of the top side of the shirt, wherein the shirt moves slightly during printing resulting in a blurred image if too much detail is attempted. Furthermore, printing of multi-colored images requires very accurate registration from one print to the next which accuracy is not achievable with belt printers due to the aforementioned freedom of movement of the shirt resting on the belt. Thus, belt press prints are usually limited to at most only two or three colors, with limited design detail.

Also, flash curing of inks is limited due to the effect of the heat on the belt. While flash curing is attainable with some belts, this is generally only employed to print on dark material in which a base of white ink is applied and flash cured prior to printing another color directly on top of the white ink. Due to the aforementioned inaccurate registration between successive prints, such accurate multi-layer printing techniques are not realizable with belt presses.

In light of the above discussed shortcomings associated with belt presses, it is desirable to provide a pallet for supporting a shirt which allows for printing over the entire surface of the shirt, particularly including the sleeves, which pallet maintains the shirt in a stationary position thereupon as the pallet is brought into successive registration with each of a plurality of printing units to provide the requisite registration accuracy necessary to make detailed multi-colored prints.

Moreover, it is desirable to provide a pallet which allows for printing over the entire surface of a shirt which lends itself to employment on conventional rotary screen presses, particularly allowing for retrofit onto pre-existing rotary screen presses. This would preclude manufacturers wishing to print images over the entire shirt surface from having to purchase a completely new press to achieve this, as is currently required.

Such pallet should lend itself to commercial production, allowing for rapid loading and unloading of shirts therefrom for good productivity and decreased turnaround time. The pallet should preferably allow for shirt loading and shirt unloading to be performed generally equally rapidly. More particularly, it should not take longer to load a shirt onto a pallet and extend the sleeve panels in preparation for printing than to unload the shirts from the pallet following printing. A slower rate of shirt loading in comparison with the rate of shirt unloading imposes a limitation on the production rate attainable with the pallet. It is an object of the present invention to provide a shirt pallet which allows shirts to be loaded as quickly as they are unloaded, thereby providing significantly increased production rates.

SUMMARY OF THE INVENTION

In accordance with the present invention there is provided a pallet for supporting shirts for printing over a substantially complete side thereof, including the sleeves, with a single print on a rotary press, which complete printing coverage is not attainable with current pallets. The pallet of the present invention maintains the shirts in a stationary position as the pallet is moved between successive print stations, allowing for significantly greater detail of prints than attainable with belt presses.

A thin upper panel is mounted to a lower panel for movement between a raised position in which the upper panel is spaced from the lower panel, and a lowered position in which the upper panel abuts the lower panel. Shirts are placed over the thin upper panel while in its raised position, with the thin panel being received within the shirt body and being of a proportional lateral width with respect to the shirt to pull the shirt body taut. To provide support to the sleeves of the shirt, separate sleeve panels are provided which are mounted to the upper panel for sliding movement outward of the upper panel at the location at which the shirt sleeves are positioned.

The sleeve panels are in a retracted position, inward of the lateral sides of the upper panel, while the shirt is pulled over the upper panel. After a shirt has been pulled onto the upper panel, the sleeve panels are then pulled outward into the arm portion of the shirt. This pulls the shirt sleeves taut. Thereafter, an operator holds the shirt taut as the upper panel is moved to its lowered position abutting the bottom panel. The bottom side of the shirt is thus secured between the upper and lower panels to maintain the shirt in a stationary position during printing. While the upper panel is too thin to withstand the loads encountered during printing operations by itself, the provision of the bottom panel onto which the upper panel is lowered provides the requisite pallet support.

A particular feature of the present invention is that the sleeve panels and upper panel form a generally continuous planar surface upon which the shirt rests during printing. Also, the sleeve panels are restrained from being pulled inward by the tautness of the shirt with the design of the present invention.

The sleeve panels include a thicker outer portion which steps down to a thinner inner portion, and are supported so that they are spaced slightly from the underside of the upper panel when the upper panel is in its raised position. There is some play in the support of the sleeve panels, such that upon lowering of the upper panel into abutment with the lower panel the sleeve panels are urged against the upper panel. The sleeve panels are retracted during shirt loading whereby the entire sleeve panel lies beneath the upper panel, spaced slightly therefrom. The sleeve panels are designed so that, upon pulling out of the sleeve panels, the thicker outer portion of the sleeve panels are brought outward of the lateral sides of the upper panel, with the thinner inner portion of the sleeve panels remaining directly beneath the upper panel.

After a shirt has been loaded and the sleeve panels pulled outward to support the shirt sleeves, the upper panel is moved to its lowered position into abutment with the lower panel. This forces the sleeve panels against the upper panel, whereby the thicker outer portion of the sleeve panels is raised upward to form a generally continuous planar surface with the upper panel. The sleeve panels are thereby also prevented from moving inward under the influence of a taut shirt due to abutment of the inner edge of the thicker outer portion of the sleeve panels against the lateral edges of the upper panel.

Accordingly, the shirt is retained in a stationary, taut position on the pallet with the entire shirt supported on a generally continuous planar surface which allows for detailed printing over an entire side of a shirt, including the sleeves, to be carried out on a rotary press.

This design allows for rapid loading and unloading of shirts while still allowing for printing over the entire surface of the shirt. Accordingly, production rates approaching that of belt printers is attainable with the pallet of the present invention without the shortcomings associated with belt presses. Furthermore, since this design lends itself to retrofit with pre-existing rotary presses, the cost for performing full shirt prints is minimal in comparison with the cost of purchasing a belt press for this purpose.

In accordance with the preferred embodiment of the present invention, there is provided such a shirt pallet having retractable sleeve panels in which the sleeve panels are biased to their extended positions. When the sleeve panels are moved to their retracted positions, they are engaged by an engaging member which holds the panels in their retracted position. After a shirt has been telescoped onto the pallet, the sleeve panels are easily disengaged from the engaging member whereby the sleeve panels automatically move to their extended position in which they are received in the sleeves of the telescoped shirt.

This precludes the need for an operator to reach inside the sleeves of a telescoped shirt to grasp the sleeve panels and thereafter pull the sleeve panels to their extended positions. Accordingly, the loading time of shirts is significantly reduced and the rate of production of shirts using this improved pallet thus greatly increased.

The means for biasing the sleeve panels to their extended positions and the engaging means are designed to allow the sleeve panels to attain a generally planar overall surface with the upper panel to which they are attached when the upper panel of the pallet is lowered onto the lower panel.

DESCRIPTION OF THE DRAWINGS

In the drawings, wherein like elements are referenced alike:

FIG. 1 is a perspective view of a pallet embodying various features of the present invention, shown with a printed shirt thereon with the upper panel in its lowered position in abutment with the lower panel;

FIG. 2 is a cut-away view of the pallet of the present invention, shown with the upper panel in its raised position;

FIG. 3 is a cross-sectional view of the panels of the pallet, taken along line 3—3 of FIG. 2 and showing the relation of the panels when the upper panel is in its raised position;

FIG. 4 is a cross-sectional view similar to that of FIG. 3 but showing the relation of the panels when the upper panel is moved to its lowered position;

FIG. 5 is a fragmentary view of the bracket attached to the upper panel to allow interchanging of upper panels;

FIG. 6 is a side elevational view of a lifting device employed to move the upper panel between its raised and lowered positions;

FIG. 7 is a perspective view of a shirt pulled over the upper panel of the pallet, with the sleeve panels retracted and the upper panel in its raised position;

FIG. 8 is a perspective view of the shirt and pallet of FIG. 7 with the sleeve panels pulled outward and the upper panel still in its raised position;

FIG. 9 is a perspective view of the shirt and pallet of FIG. 8, shown with the upper panel moved to its lowered position into abutment with the lower panel;

DETAILED DESCRIPTION OF THE PREFERRED EMBODIMENT

A first embodiment of a pallet embodying various features of the present invention is illustrated in FIGS. 1-12 and referred to generally at 20. With initial reference to FIG. 12, the pallet 20 comprises a thin upper or top panel 22 which is pivotally connected to a lower or bottom panel 24 through a hinge 25 to allow for pivotal movement of the upper panel 22 between a raised position in which the upper panel 22 is spaced from the lower panel (see FIG. 7), and a lowered position in which the upper panel 22 abuts the lower panel 24 (see FIG. 9). The thinness of the upper panel 22 minimizes the amount of shirt material at its lateral sides so that a print can be made over the entire front surface of a shirt and another over the entire back surface of a shirt which prints will nearly meet. This is in contrast with conventional pallets in which the pallet is unibody, having a thickness which causes large gaps between prints done on the frontside of the shirt and prints done on the backside of the shirt. Simply making the conventional unibody pallets thinner is not a feasible alternative since the thin pallets do not provide enough strength to withstand the loads encountered during printing. Thus, the provision of separate upper and lower panels is required.

Figure 10:
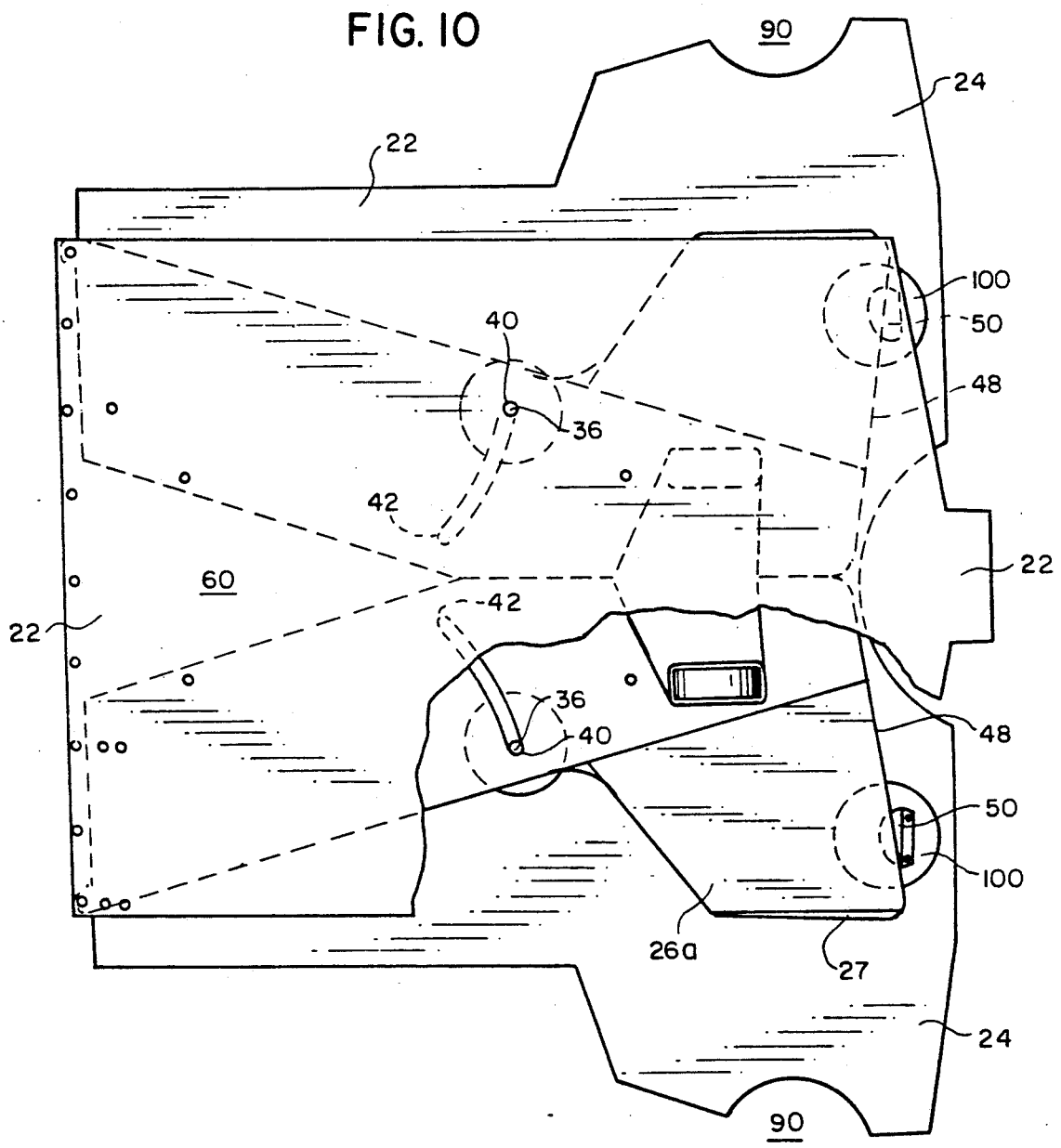
FIG. 10 is a plan view of the pallet of the present invention, shown with the sleeve panels moved to their retracted position.
Figure 11:
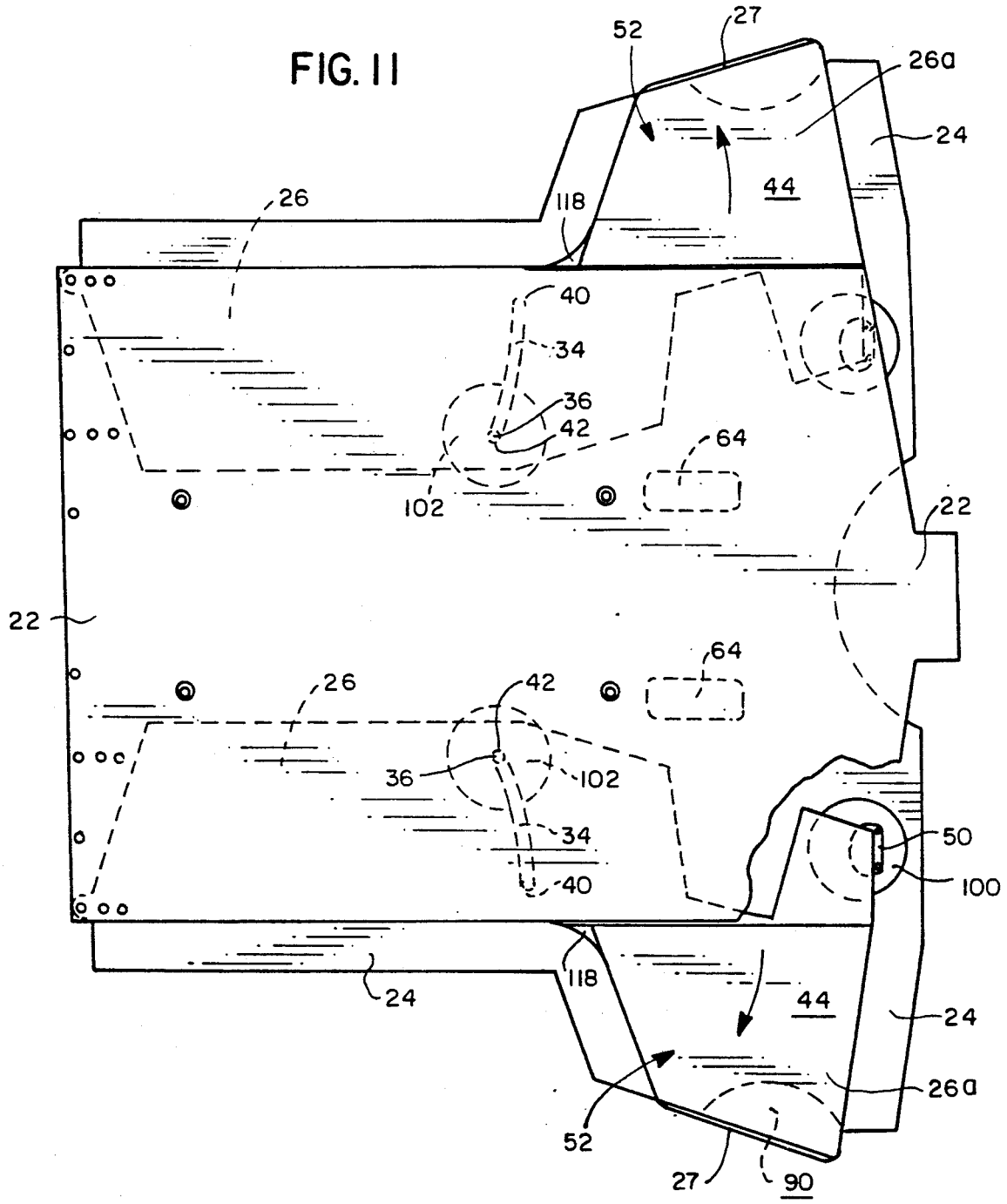
FIG. 11 is a plan view of the pallet illustrated in FIG. 10, shown with the sleeve panels moved to their extended position.

The upper panel 22 has two sleeve panels 26 mounted thereto for pivotal movement between a retracted position as illustrated in FIG. 10 and an extended position as illustrated in FIG. 11. A shirt 28 to be printed is pulled taut over the upper panel 22 with the sleeve panels 26 in their retracted position, as illustrated in FIG. 7. Then the sleeve panels 26 are pulled outward to their extended position into the sleeve of the shirt 28 to pull the shirt sleeve taut, with the upper panel 22 maintained in its raised position, as illustrated in FIG. 8. Thereafter, the upper panel 22 is lowered and rests on the lower panel securing the shirt 28 between the upper and lower panels.

To allow for movement of the sleeve panels 26 between their retracted and extended positions, in the preferred embodiment the sleeve panels 26 include a pivot aperture 30 and the upper panel 22 includes a mounting aperture 32 through which the sleeve panel 26 is mounted for pivotal movement with respect to the upper panel 22 about the pivot apertures.

The extent of pivotal movement of the sleeve panels 26 with respect to the upper panel 22 is defined by arcuate slots 34 formed in the sleeve panels 26. Pins 36 extend from the upper panel 22 down through the arcuate slots 34, and are retained within the arcuate slots 34 by washers 38. Thus, as seen in FIG. 10, as the sleeve panels 26 pivot about the pivot aperture 30, the extent of retraction of the sleeve panels 26 is defined by abutment of the pin 36 against the outer end 40 of the arcuate slot 34, and the extent of extension of the sleeve panels 26 is defined by abutment of the pin 36 against the inner end 42 of the arcuate slot 34. This precludes the need for precise operator positioning of the sleeve panels 26 and also provides support of the sleeve panels. The washers are preferably formed of plastic material to allow low friction sliding.

For reasons to be discussed below, it is desirable that the washers 38 be spaced from the upper panel so that there is space or play between the upper side 44 of the thickened outer section 52 of the sleeve panels 26 and the underside 46 of the top panel 22. Further support of the sleeve panels 36 is provided by receipt of the upper end 48 of the sleeve panels within brackets 50 mounted to the underside 46 of the upper panel 22. The brackets 50 allow for some movement of the sleeve panels 26 therein between the position of FIG. 3 in which the sleeve panel 26 is spaced from the upper panel 22, and the position of FIG. 4 in which the sleeve panel 26 abuts the upper panel 22. This is an important aspect of the present invention which is discussed in detail below.

In order to provide for a generally continuous planar surface upon which to carry out printing operations, and to prevent the sleeve panels 26 from being pulled toward their retracted position under the influence of the tautness of a shirt stretched thereacross, the sleeve panels 26 include thicker outer sections 52. In the preferred embodiment of the invention, the thicker outer sections 52 of the sleeve panels 26 are formed by simply attaching a small plate 26*a* to the top surface 54 of the sleeve panels 26. While this is preferred for economy of manufacture, clearly other suitable means of forming a thickened or widened outer section 52 may be employed without departing from the inventive concepts of the present invention.

The thickened outer sections 52 of the sleeve panels 26 extend only to the lateral sides 56 of the upper panel 22 when the sleeve panels 26 are moved to their extended positions. That is, the thickened outer sections 52 step down along a line or path defined by the position of the lateral side 56 of the upper panel 22 with respect to the sleeve panel 26 when the sleeve panel is moved to its extended position, as best seen in FIG. 2.

The aforementioned provision of space between the sleeve panel 26 and the underside 46 of the upper panel 22 accomplishes at least two separate objectives.

First, it allows the thickened outer section 52 of the sleeve panels 26 to slide beneath the upper panel 22 without contacting the underside 46 thereof. This is particularly important in applications in which adhesive spray is applied to the upper surface 44 of the outer section of the sleeve panels 22 to assist in securing the shirt 28 in a stationary position. Without the sufficient clearance allowed by the bracket 50 support, the sleeve panels 22 would get hung up when moving between extended and retracted positions.

Second, with reference to FIGS. 3 and 4, after the sleeve panels 26 have been moved to their extended position with the upper panel raised, the sleeve panels 26 remain spaced slightly from the underside 46 of the upper panel 22. With the sleeve panels 26 fully extended and the upper panel 22 in its raised position, as shown in FIG. 3, the thickened outer sections 52 of the sleeve panels 26 are positioned such that the inner edge or step down 58 thereof extend just outward of the lateral sides 56 of the upper panel 22, being also spaced slightly below the upper panel 22. Thus, upon lowering of the upper panel 22 onto the lower panel 24, the sleeve panels 26 are forced against the underside 46 of the upper panel 22, thereby taking up the space therebetween. This raises the thickened outer section 52 of the sleeve panels 26 upward to bring the upper surface 44 of the thickened outer section 52 of the sleeve panels 26 into generally level with the upper surface 60 of the upper panel 22. Accordingly, after the shirt 28 has been secured on the upper panel 22 and the panel is thereafter lowered into abutment with the lower panel 24, the entire shirt, particularly including the sleeves, is supported on a generally planar surface for printing.

It is desirable to minimize the gap between the inner edge 58 of the sleeve panels 26 and the lateral sides 56 of the upper panel 22. Otherwise the print will be distorted thereat. The design of the present invention accomplishes this objective inherently. When the sleeve panels 26 are extended, the shirt 28 is pulled taut. The tautness of the shirt 28 exerts an inward force on the sleeve panels 26, tending the panels 26 toward their retracted position.

While this would result in inward movement of the sleeve panels 26 were the upper panel 22 maintained in its raised position, due to the aforementioned allowance of space for movement of the thickened outer section 52 beneath the upper panel 22 (as best illustrated in FIG. 3), the sleeve panels 26 are prevented from moving inward when the upper panel 22 is in its lowered position due to abutment of the inner edge 58 of the sleeve panels 26 against the lateral side 56 of the upper panel 22.

Thereafter, following printing operations, the upper panel 22 is raised again and the shirt pulled off the pallet 20, so that the sleeve panel 26 resumes the position illustrated in FIG. 3.

The potential for pinching a portion of the shirt between the sleeve panels 26 and the upper panel 22 upon retraction of the upper panel is also minimized by the construction of the preferred embodiment. Since the upper surface 44 of the sleeve panels 26 drops down to a plane below the upper surface 60 of the upper panel 22 upon raising of the upper panel 22, the shirt 28 is thereby peeled from the adhesive which is normally employed on the upper surface 44 of the sleeve panels upon raising of the upper panel 22. Thus, the shirt is peeled from the sleeve panels 26 prior to retraction of the sleeve panels 26, so that the shirt does not stick to the sleeve panels when they are retracted, whereby otherwise the portion of the shirt adhering to the sleeve panel would be pulled and pinched between the panels.

To move the upper panel 22 between its raised position in which it is spaced from the lower panel 24, and its lowered position in which the upper panel 22 abuts and rests atop the lower panel 24, wheels 62 are employed. With reference now to FIG. 6, wheel openings 64 are provided in the lower panel 24 through which the wheels 62 are raised to lift the upper panel 22 to its raised position, as shown in FIG. 2. The wheels 62 are lowered to a position beneath the lower panel 24 to bring the upper panel 22 to its lowered position abutting the lower panel 24.

Any of the several commercially available over-center devices 66 can be employed to lock the wheels 62 in a raised position by movement of a handle 68 in a first direction, and thereafter lower the wheels 62 by movement of the handle 68 in an opposite second direction. A DE-STATO-202 clamp has been found to be effective. As best seen in FIG. 6, a pair of wheel mounting blocks 70 are affixed to the underside 72 of the lower panel 24. A wheel supporting axle 74 spans the wheel mounting blocks 70 and is mounted for rotation therein. An actuating bracket 76 and a pair of wheel supporting brackets 78 are fixedly secured to a common wheel supporting axle 74 whereby raising the actuating bracket 76 effects the simultaneous raising of the pair of wheel supporting brackets 78 and, hence, raising of the pair of wheels 62 through the wheel openings 64 as illustrated in FIG. 6.

Hence, an operator moves the handle 68 of the over-center device to raise the wheels 62 upward through the wheel openings 64 provided in the lower panel 24, whereby the wheels 62 exert an upward force against the underside 46 of the upper panel 22 to lift the upper panel 22 to its raised position, as illustrated in FIGS. 2 and 6.

With the upper panel 22 in its raised position supported upon the wheels 62 and the sleeve panels retracted, an operator pulls a shirt 28 taut over the upper panel 22 so that the upper panel 22 and sleeve panels 26 are received within the shirt 28. Then, the operator grips the lip 27 of the sleeve panels 26 and pulls them outward to their extended position into the sleeves of the shirt to make the shirt sleeves taut. Since it is desirable to hold the shirt taut as the upper panel 22 is lowered onto the lower panel 24, a hydraulic or pneumatic cylinder 82 is mounted to the frame 84 of a press. The cylinder 82 is actuated by a foot switch 86 connected thereto which reciprocates a knock-out arm 88 to knock the handle 68 of the over-center device to lower the wheels 62 and hence lower the upper panel 22. This allows the operator to maintain a grip on the sleeve panels 26 with both hands to keep the shirt taut while the upper panel 22 is lowered. Of course, pneumatic or hydraulic cylinders can be employed to both raise and lower the upper panel 22, however, since it takes less time to unload a shirt from the pallet 20 than to load a shirt onto the pallet 20, the expense associated with such fully foot operated raising and lowering is not justified.

The lower panel 24 includes arcuate recesses 90 where the lips 27 of the sleeve panels 26 meet the lower panel 24 in their extended positions. This allow the operator to maintain a grip on the sleeve panels 24 during lowering of the upper panel 22, without concern for fingers getting caught between the upper panel 22 and lower panel 24.

To prevent the wheels 62 from impeding the movement of the sleeve panels 26 between retracted and extended positions, the sleeve panels are provided with cutout sections 80. That is, with the sleeve panels in their retracted position, were it not for the provision of the cutouts 80, the wheels 62 would be forced against the sleeve panels 26 when raised, rather than being forced directly against the upper panel 22. The abutment of the wheels 62 against the sleeve panels 26 would provide undesirable resistance to outward movement of the sleeve panels 26 were it not for the provision of the cutouts 80.

Other means for raising and lowering the upper panel 22 with respect to the lower panel 24 can be employed without departing from the inventive concepts of the present invention. For instance, springs can be employed at the base 82 of the upper panel 22. However, such arrangements have been found to result in bowing of the relatively thin upper panel 22 under its own weight when the upper panel elevating means is positioned at the base rather than being spaced from the base, as provided for with the wheel arrangement of the present invention. The wheel arrangement of the present invention is desirable in that the rolling action of the wheels 62 allows the shirt 28 to pass between the wheels 62 and the underside 46 of the upper panel 22 with little resistance.

Figure 12:
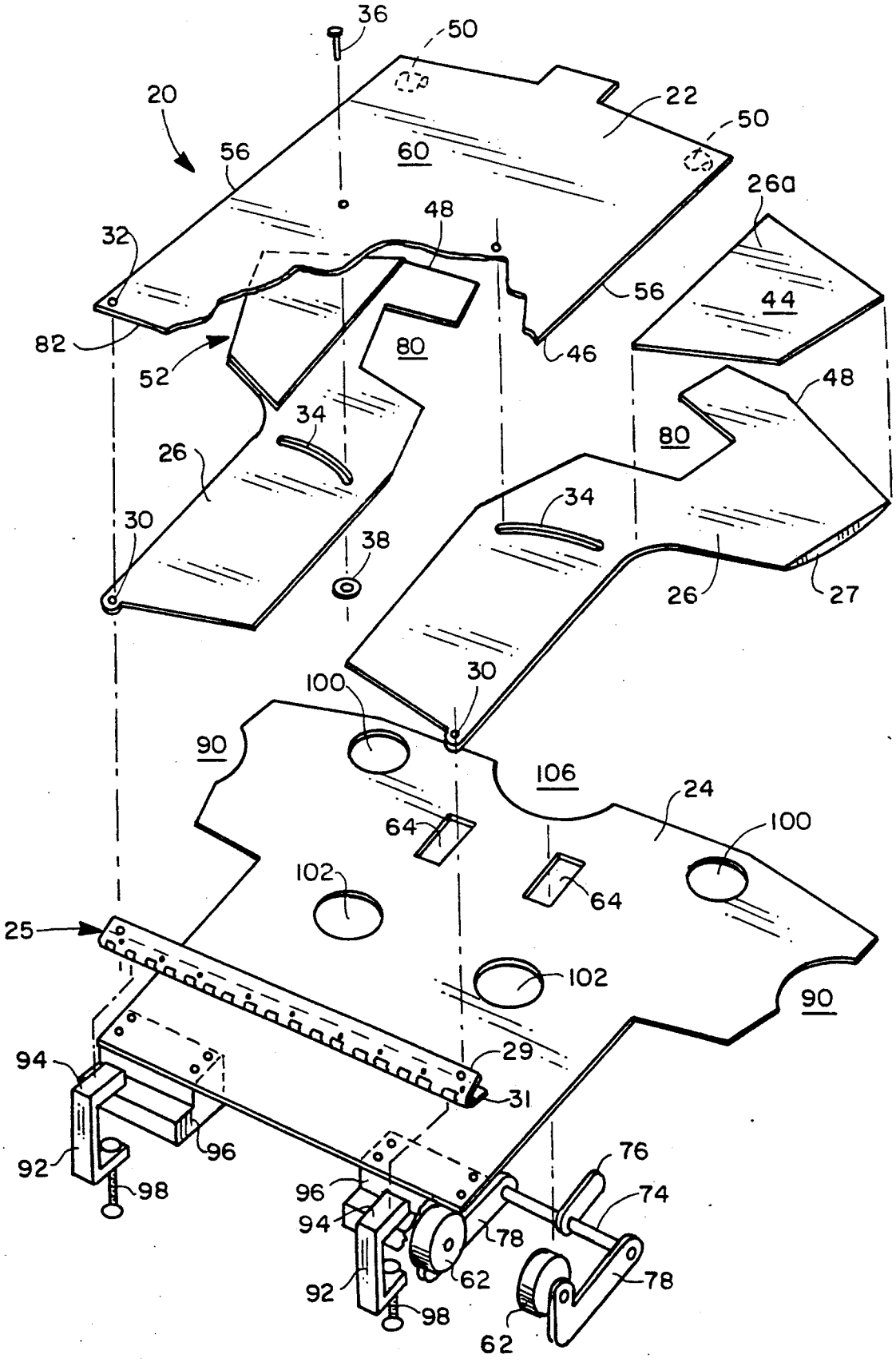
FIG. 12 is an exploded view of the pallet of FIG. 1.

In this embodiment of the invention, the panels are all interconnected at the hinge 25. As seen in FIG. 12, the hinge includes an upper flange 29 and a lower flange 31. The upper panel 22 and sleeve panels 26 are connected to the upper flange 29 of the hinge 25, and the lower flange 31 of the hinge 25 is connected to the upper end 94 of the clamps 92. The clamps 92 are then in turn clamped to mounting brackets 96 which are mounted to the underside 72 of the lower panel 24.

Thus, the lower panel 24 and the mounting blocks 96 mounted to the underside 74 thereof are permanent components, and remain mounted to the press, while the upper panel 22 which is connected to the clamps 92 through hinges 25 is removable from the lower panel 24 by simply loosening the clamping screws 98 of the clamp 92. This arrangement allows for accommodation of differently sized shirts since the upper panel 22 is mounted for simple and rapid interchangeability.

Hence, any number of differently sized upper panels 22 can be maintained to accommodate differently sized shirts 28, with each upper panel 22 being connected to respective clamps 92 through hinges 25, whereby upper panels 22 are readily interchangeable by simply clamping and unclamping to the mounting blocks 96. Once clamped, the upper panel 22 is then hingedly connected to the lower panel 24 for pivotal movement with respect thereto.

To assure that the upper panel 22 rests flat against the lower panel 24, the lower panel is provided with a number of cutouts to accommodate hardware extending downward from the underside 46 of the upper panel 22. Specifically, in the illustrated embodiment, bracket cutouts 100 are provided in the bottom panel 24 to accommodate the brackets 50 and pin cutouts 102 are provided in the lower panel 24 to accommodate the pins 36 and their associated washers 38. Depending upon the exact pallet construction utilized, should it differ from the illustrated embodiments, other cutouts may be required so that the upper panel 22 lays flat atop the lower panel 24 to assure securing of the shirt 28 therebetween.

To further assure that the upper panel 22 lays flat against the lower panel 24, a neck cutout 106 is provided in the bottom panel 24 to accommodate the thickened neck portion of T-shirts therein, which thickness in relation to the remainder of the T-shirt would otherwise preclude the upper panel 22 from laying flat upon the lower panel 24.

Thus, in operation of the pallet 20 of the embodiment discussed above, an operator first manually raises the upper panel 22 by movement of the handle 68 to unload a previously printed shirt 28 as it resides at an unloading station. Thereafter, the pallet 20 moves to an adjacent loading station while still remaining in its raised position. Thereat, an operator pulls a new shirt 28 to be printed upon over the upper panel 22 by sliding the lower end of the shirt between the wheels 62 and the upper panel 22 and the upper end of the shirt over the upper surface 60 of the upper panel 22. Then the operator extends the sleeve panels 26 by pulling on the lip 27 thereof and pivoting the sleeve panels 26 into the sleeves of the shirt. While holding the sleeve panels 26 outward the operator steps on the foot switch 86 to actuate the hydraulic cylinder 82 and knock out the handle 86 to lower the wheels 62 and hence lower the upper panel 22. This secures the underside of the shirt 28 between the upper panel and the lower panel 24 to maintain the shirt in a stationary position as it then advances through a plurality of printing operations. When the shirt moves around to the unloading station following the printing operations, an operator manually raises the upper panel 22 by movement of the handle 86 and slide the printed shirt off the pallet 20. Thereafter, the raised pallet 20 advances to the loading station whereat the above procedure is repeated.

Figure 13:
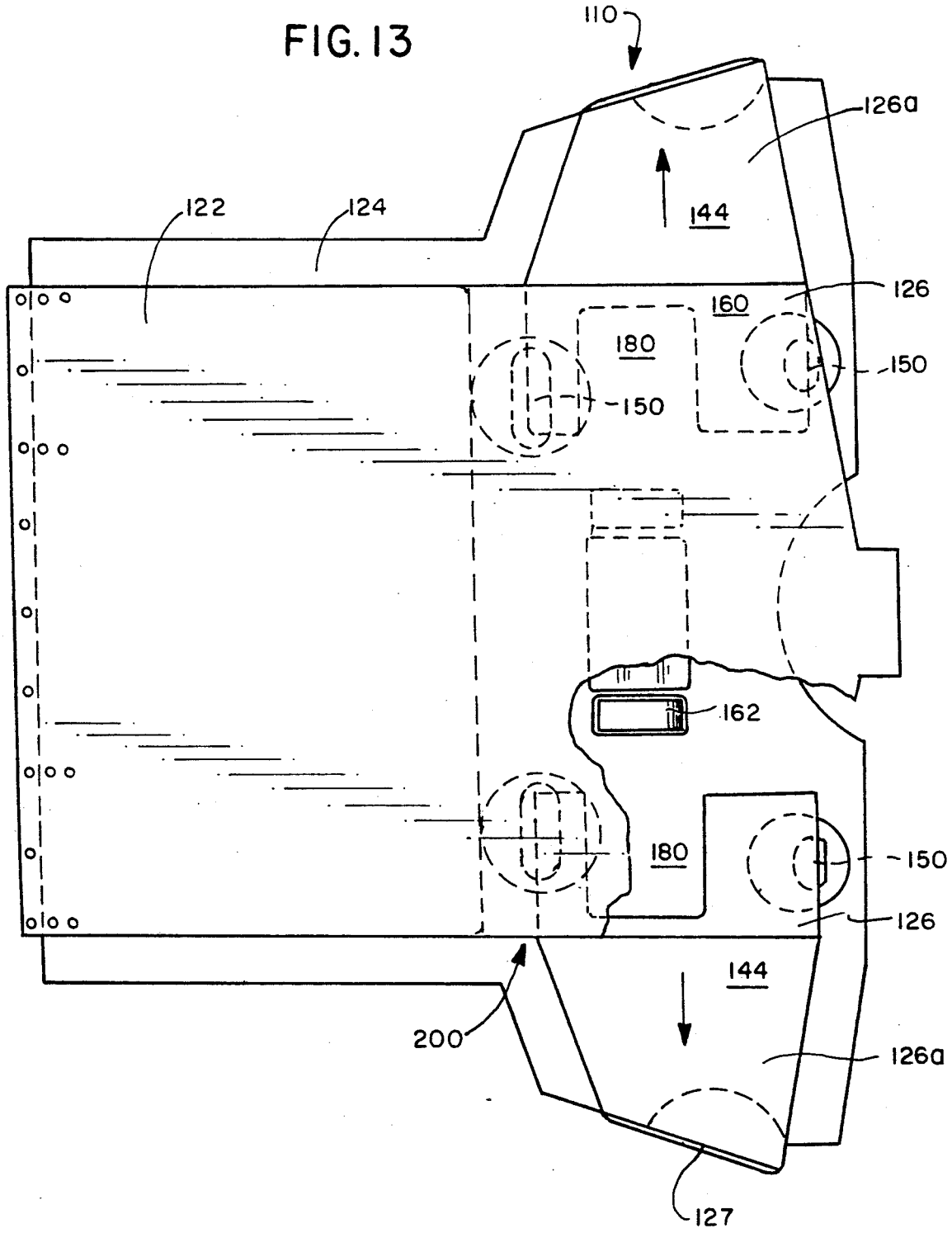
FIG. 13 is a plan view of an alternative embodiment of a pallet embodying various features of the present invention.
Figure 14:
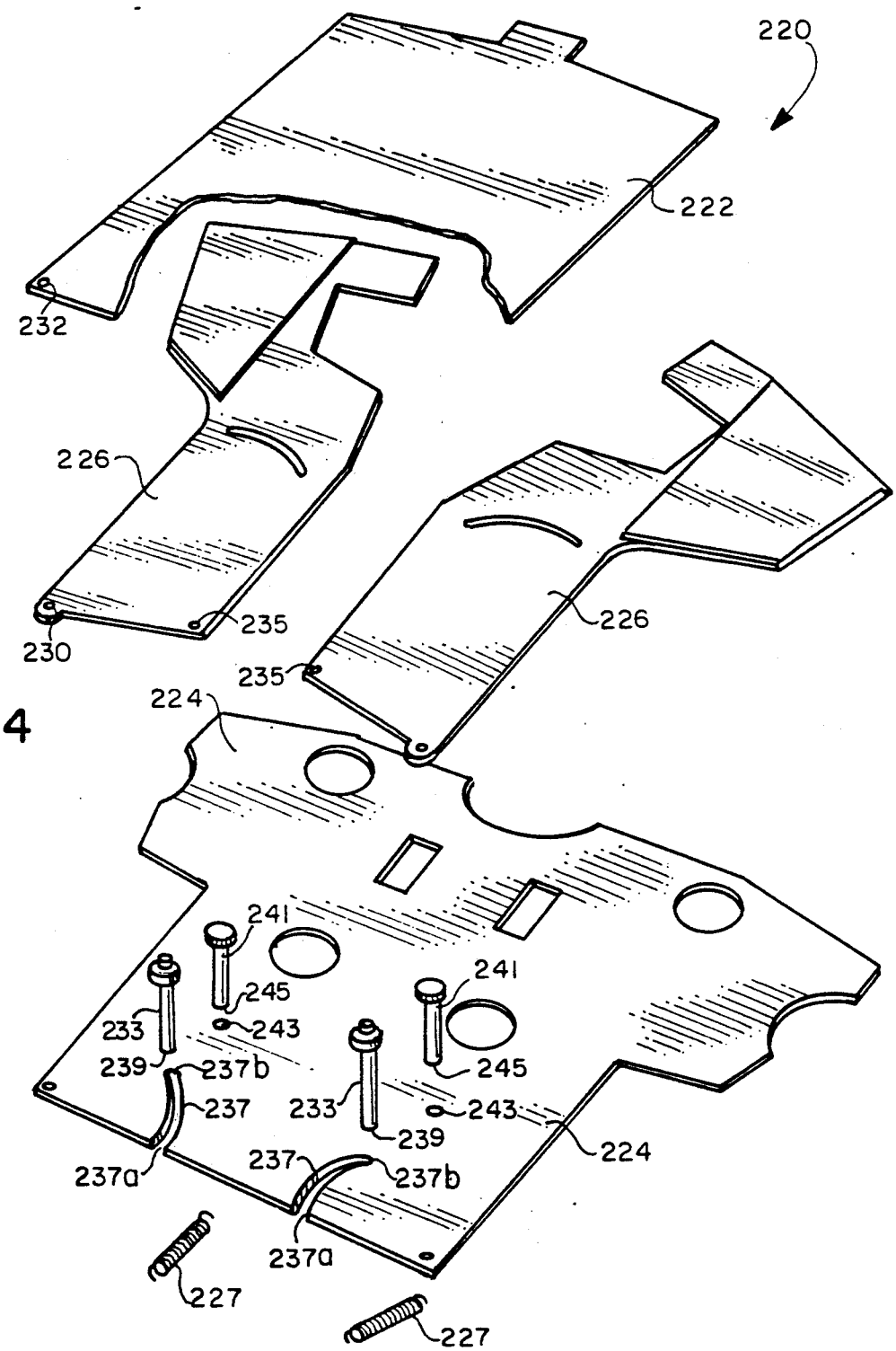
FIG. 14 is an exploded view of another embodiment.

An alternative embodiment of a pallet embodying various features of the present invention is illustrated in FIG. 13. This embodiment is similar to the above embodiment in that the upper panel 122 is pivotally connected to the lower panel 124 and includes generally all of the other features of the pallet 20 of the above embodiment such as the wheel lifting mechanism and the like. This alternative embodiment, however, differs from the above embodiment in the construction of the sleeve panels. The sleeve panels 126 of the embodiment of FIG. 13 slide linearly between retracted and extended positions, rather than pivoting.

Each sleeve panel 126 includes two brackets 150 which the support the sleeve panel 126 for drawer-like sliding. An operator grips the lips 127 of the sleeve panels and pulls then outward into the sleeves of the shirt. As with the above embodiment, and for the reasons delineated with respect to the above embodiment, the outer section **126*a* of the sleeve panels 126 is made thicker than the inner section 126 of the sleeve panels. Thus, the brackets 150 should be designed to provide space for movement of the sleeve panels 126 therein. Hence, the thickened outer section 126*a* of the sleeve panels moves between a suspended position spaced from the upper panel 122 when the upper panel 122 is raised, to a position flush against the upper panel 122 when the upper panel is lowered, with the upper surface 144 of the thickened outer section 126*a* being moved to a position planar with the upper surface 160 of the upper panel 122 when the upper panel 122** is lowered.

The sleeve panels include cutouts 180 to accommodate the wheels 162 similar to the cutouts 80 provided in the sleeve panels 26 of the above embodiment.

This embodiment is not preferred in that it results in sharp corners 200 at the support of the armpits of the shirt, in contrast with the smooth radius 118 provided at the armpits in the preferred embodiment. This radius 118 pulls the shirt taut at the armpits to allow printing thereat. Also, the linear drawer-like sliding has been found to cause significantly more hang-ups than the pivotal arrangement of the sleeve panels provided in the preferred embodiment of the invention.

It has been found that the aforementioned embodiment, wherein the sleeve panels 226 are moved to their extended position manually by an operator reaching through the sleeves of the shirt 228 to grasp and pull the sleeve panels 226 outwardly, does not optimize production rates. The production rate is limited by the rate of shirt loading, with shirt unloading being significantly faster than shirt loading. This is due to the fact that the operator loading the shirts onto the pallet must first telescope a shirt over the upper panel 222, then reach inside the shirt sleeves and grope around to find the sleeve panels 226 and then finally pull the sleeve panels 226 outward to their extended position.

In order to eliminate the need for an operator to reach inside the shirt sleeves, find the sleeve panels 226, and pull the sleeve panels outward to their extended position, and thereby reduce the set-up time associated with such actions, in the preferred embodiment the sleeve panels 226 are made to move to their extended position within the shirt sleeves automatically.

Hence, the sleeve panels 226 are biased toward their extended position so that when released they will move outward into the sleeves of a shirt 228 loaded on the pallet 220. When pivoted to their retracted position, the sleeve panels 226 engage with an engaging means to retain the sleeve panels 226 in their retracted position. With the sleeve panels retained in their retracted position by the engaging means, a shirt 228 is loaded onto the pallet. Thereafter, the engaging means is disengaged to allow the sleeve panels to move automatically to their extended position under the influence of the biasing means. Thus, by eliminating the steps of reaching into the shirt sleeves, locating the sleeve panels and pulling them outward into the shirt sleeves, the rate of shirt loading is increased dramatically. In trial runs, it was found that employing the biasing and engaging means to move the sleeve panels automatically outward reduces shirt loading time from approximately 10 or 11 seconds to approximately 3 or 4 seconds. Since all of the pallets 220 on a screen printing press rotate simultaneously, the production rate of shirts is limited by the slower of the shirt loading or shirt unloading operations. Since shirt unloading takes approximately 3 or 4 seconds, the production rate of pallets not employing automatically extending sleeve panels was limited by the 10 or 11 second shirt loading time, whereas with the automatically extending sleeve panels the production rate is thus no longer limited by the slower shirt loading rate, with the pallet allowing for shirts to be loaded as fast as they can be unloaded. Hence, the overall production rate is increased more than threefold.

Figure 15:
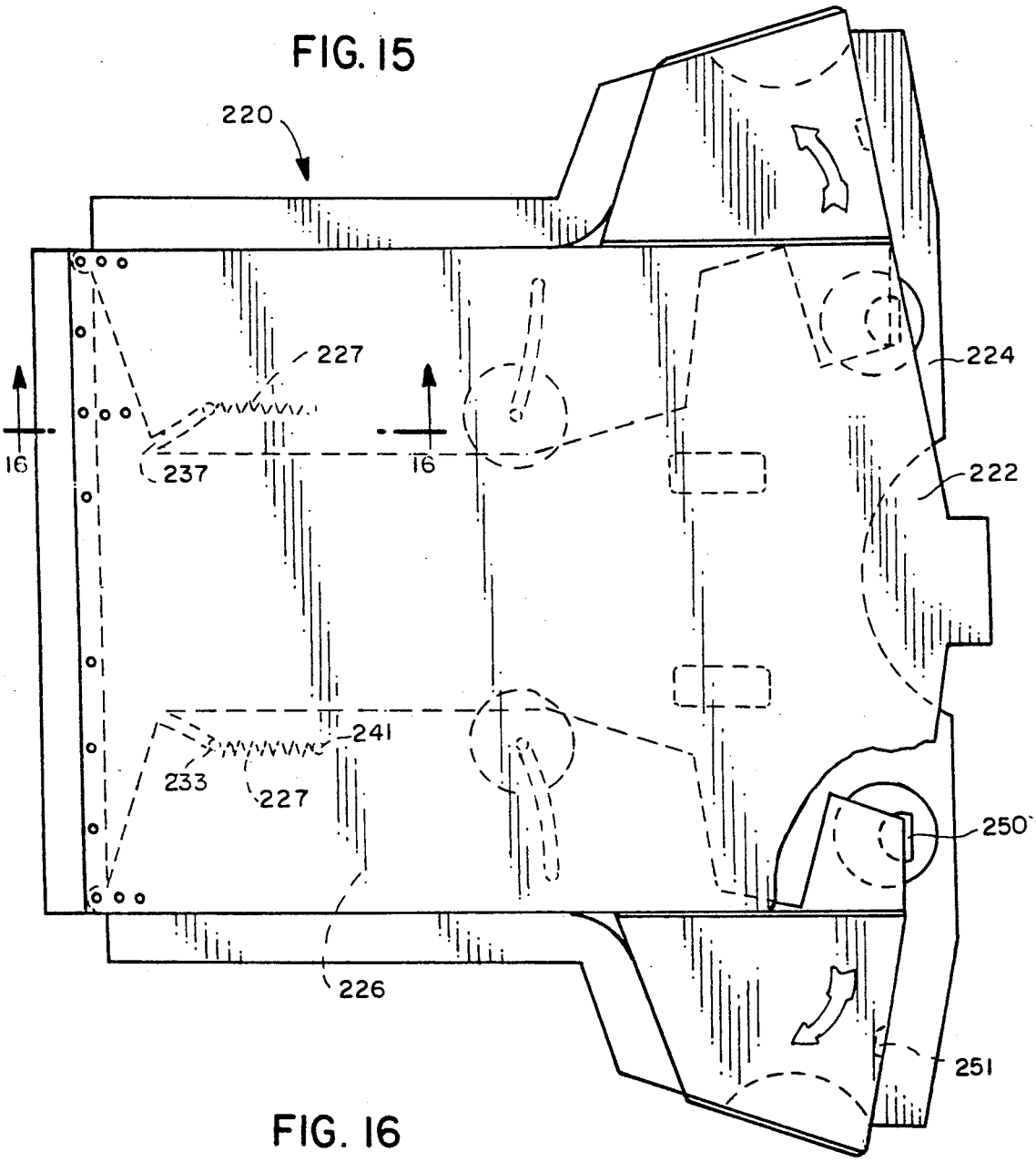
FIG. 15 is a plan view of the assembly of FIG. 14 with the sleeve panels extended.
Figure 16:
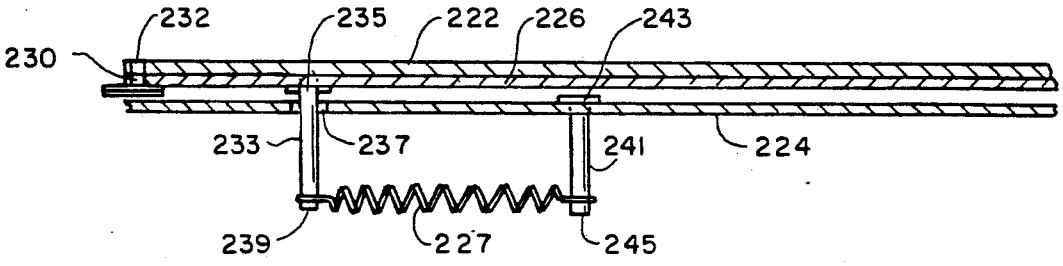
FIG. 16 is a cross-sectional view of the panels of the pallet assembly along line 16—16 of FIG. 15.
Figure 17:
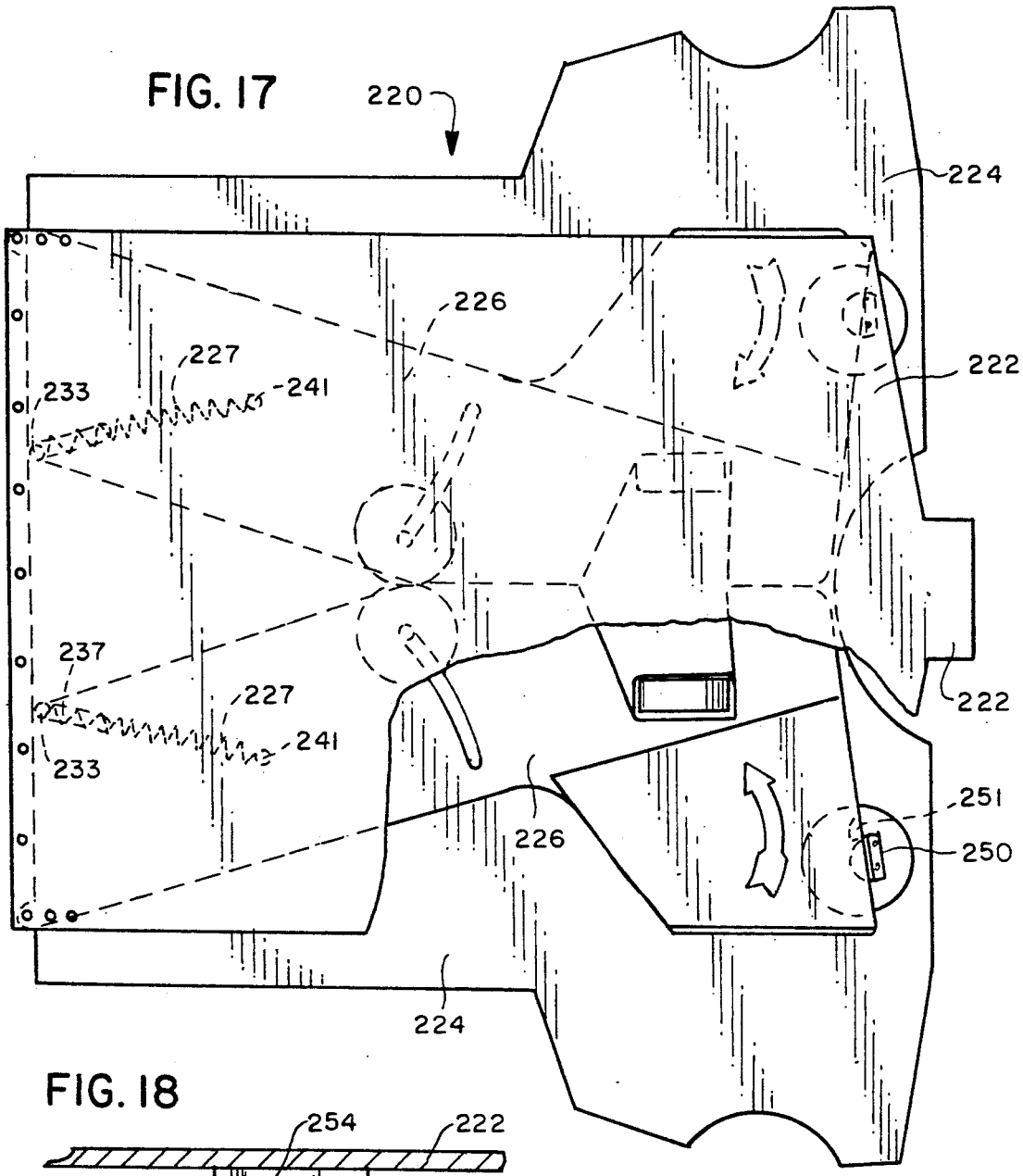
FIG. 17 is a plan view of the assembly of FIG. 14 with the sleeve panels retracted.

This preferred embodiment of the invention is illustrated in FIGS. 14–19. As best seen in FIGS. 15 and 17, the sleeve panels 226 are biased to their extended position by springs 227. The sleeve panels 226 are pivotally joined to the upper panel 222 through respective pivot axes 230 and 232, as with the above embodiment, so that the sleeve panels 226 pivot with respect to the upper panel 222 about the pivot axes. To bias the sleeve panels 226 to their extended position, whereby they will tend to pivot automatically outward about their pivot axes 230, the springs 227 extend between the sleeve panels 226 and the lower panel 224. While a virtually limitless number of arrangements and means for biasing the sleeve panels 226 may be employed, the spring arrangement of FIGS. 14–19 has been found to provide outstanding results and is described in detail below.

Pins 233 are mounted in pin apertures 235 of the sleeve panels 226 to depend downwardly therefrom. Arcuate slots 237 are formed in the lower panel 224 to receive the pins 233 for sliding movement therein. Thus, as seen in the cross-sectional view of FIG. 16. the pins 233 extend downwardly from the sleeve panels 226 through the arcuate slots 237. As the sleeve panels 226 pivot from their retracted position of FIG. 17 to their extended position of FIG. 15, the pins 233 move within the arcuate slots 237 from the exterior end **237*a* of the slots 237 to the interior end 237*b* of the slots 237 (compare FIGS. 15 and 17). For reasons which will become clear below, the pins 233 are long enough so that the ends 239 of the pins 233 extend through the arcuate slots 237 when the upper panel 222 is raised as well as when the upper panel 222 is lowered. Thus, the ends 239 of the pins 233 remain below the lower panel 224 throughout pivotal movement of the sleeve panels 226 between extended and retracted positions and throughout raising and lowering of the upper panel 222 with respect to the lower panel 224**.

Stationary pins 241 are mounted to the lower panel 224 through pin aperture 243 with the stationary pins 241 depending downwardly from the lower panel 224. Thus, the ends 245 of the stationary pins 241 remain stationary beneath the lower panel 224. As best seen in the cross-sectional view of FIG. 16, springs 227 join the pins 233 and 241 near the ends 239 and 245 thereof. With the stationary pins 241 positioned laterally outwardly of the arcuate slots 237, the springs 227 act to bias the pins 233 toward the interior end **237*b* of the arcuate slot 237. Thus, the springs 227 bias the sleeve panels 226 toward their extended position. While the end 239 of the pin 233 will be raised and lowered upon raising and lowering of the upper panel 222, the pin 233 is long enough so that its end 239 remains beneath the lower panel 224 throughout raising and lowering of the upper panel 222. Hence, regardless of the raising and lowering of the upper panel 222, the spring 227 extends between the two pins 223 and 241 beneath the lower panel 224, thereby continually biasing the sleeve panels 226** to their extended position.

Shirts are telescoped onto the upper panel 222 with the sleeve panels 226 in their retracted position, and thereafter the sleeve panels 226 are moved to their extended position whereat the sleeve panels 226 are received within the sleeves of the shirt. In order to retain the sleeve panels 226 in their retracted position during shirt loading, means are provided for temporarily engaging the sleeve panels 226 with the supporting bracket 250.

Figure 18:
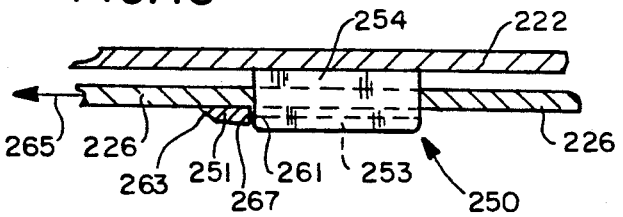
FIGS. 18 and 19 are details showing the restraining means for engaging and releasing the sleeve panels.
Figure 19:
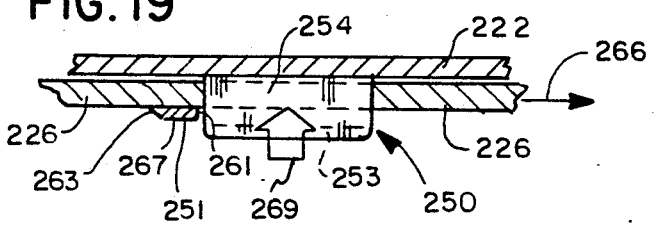

With particular reference now to FIGS. 18 and 19, the sleeve panels 226 include a lip 251 depending from the underside thereof which lip 251 engages with the lower, horizontal leg 253 of the bracket 250 to prevent the sleeve panels 226 from sliding outward within the bracket 250 until the sleeve panel 226 is raised within the bracket 250 to raise the lip 251 above the lower, horizontal leg 253 of the bracket 250 and allow the lip 251 to slide through the bracket 250.

More particularly, as described above, the sleeve panels 226 slide within the bracket 250 which provides support to the sleeve panels. The bracket 250 depends from the upper panel 222 and includes a vertical leg 254 and a lower, horizontal leg 253. The sleeve panel 226 rests on the horizontal leg 253 of the bracket 250 as it slides within the bracket between extended and retracted positions. The lip 251 includes a flat bearing surface 261 on one side thereof, a ramped camming surface 263 on the other side thereof, and a lower surface 267.

When the sleeve panels 226 approach their fully retracted position upon being manually pushed inwardly in the direction of arrow 265 in FIG. 18, the camming surface 263 of the lip 251 bears against the lower leg 253 of the bracket to raise the lip 251 and the sleeve panel 226 within the bracket 250 until the lower surface 267 of the lip 251 is raised above the lower leg 253 of the bracket 250. This allows the lip 251 to clear the lower leg 253 of the bracket 250 and slide through the bracket 250 as the sleeve panels 226 are pushed inward. Upon further inward pushing of the sleeve panels 226, the lip 251 slides completely through the bracket 251. The weight of the sleeve panels 226 causes the lip 251 to fall downward from the lower leg 253 of the bracket 250 as the lip 251 clears the bracket, with the sleeve panel and lip taking on the position of FIG. 18. The flat bearing surface 261 then bears against the lower leg 253 of the bracket 250 and prevents the lip 251 from moving back through the bracket 250 under the influence of the springs 227. Accordingly, the sleeve panels 226 are maintained in their retracted position by engagement of the lip 251 with the bracket 250, whereby a shirt can be loaded onto the pallet with the sleeve panels 226 in their retracted position without the need of an operator holding the sleeve panels 226 to maintain them in their retracted position.

After a shirt has been telescoped over both the upper panel 222 and retracted sleeve panels 226, it is then desired to release the sleeve panels 226 and allow them to move to their extended position automatically under the influence of the springs 227 as described above. To disengage the sleeve panels 226, the sleeve panels are simply lifted upward slightly within the bracket 250 to allow the lip 251 to clear the bracket 250. With particular reference to FIG. 19, the sleeve panel 226 is lifted upward as indicated by arrow 269, to raise the lower surface 267 of the lip 251 above the lower leg 253 of the bracket 250 and allow the lip 251 to then pass through the bracket 250 as the sleeve panels 226 move automatically toward their extended position in the direction of arrow 266. That is, while abutment of the abutting surface 261 of the lip 251 against the lower leg 253 of the bracket 250 prevents the lip 251, and hence the sleeve panels integral therewith, from sliding through the bracket 250 during shirt loading, the sleeve panels 226 move rapidly and automatically to their extended position within the sleeves of the loaded shirt by merely raising the sleeve panels 226 slightly. Thereby, the lip 251 is raised above the lower leg 253 of the bracket 250 and the lip 251, together with the sleeve panels 226 integral therewith, can then slide freely through the bracket 250 to their extended position. Accordingly, the requirement of an operator to reach inside the shirt sleeves and manually pull the sleeve panels 226 outward to their extended position is eliminated.

Pushing inward of the sleeve panels 226 in the direction of arrow 265 with the lip 251 moving beyond the retracted position (to the left of the position shown in FIG. 18) does not affect the performance of the pallet 220. Since the sleeve panels 226 are biased toward their extended position, opposite arrow 265, the sleeve panels will automatically be drawn back opposite the direction of arrow 265 until the bearing surface 261 abuts the bracket 250 in the position of FIG. 18.

In operation, the upper panel 222 with the sleeve panels 226 pivotally mounted thereto is first raised from the lower panel 224. The sleeve panels 226 are then manually pushed inward until the lip 251 thereof passes through the bracket 250. The sleeve panels are then released, upon which the abutting surface 261 of the lip 251 engages with the lower leg 253 of the bracket 250 to maintain the sleeve panels 226 in their retracted position. This provides an operator with both hands free to telescope a shirt over the upper panel 222 and retracted sleeve panels 226.

The operator then lifts upward slightly on the sleeve panels 226 to raise them within respective brackets 250 and allow the lips 251 to clear the lower leg 253 of the bracket 250. Thereupon, the sleeve panels 226 move rapidly to their extended position under the influence of the springs 227, being received within the shirt sleeves to provide support thereto. There is no need for an operator to reach inside the shirt sleeves and no need for the operator to manually move the sleeve panels 226 to their extended position. After the sleeve panels 226 have been disengaged and move to their extended position, the upper panel 222 is lowered onto the lower panel 224 to secure the shirt in a stationary position during printing, as described in detail above with respect to the other embodiments of the invention. Following the completion of printing operations on the shirt, the upper panel 222 is again raised and the sleeve panels 226 manually pushed inward to their retracted position, with the sleeve panels 26 retained thereat by engagement of the lip 251 with the bracket 250. This provides the operator with both hands free for removing the printed shirt from the pallet 220.

While the invention has been described with reference to preferred embodiments, it will be understood to those skilled in the art that various changes may be made and equivalents may be substituted for elements thereof without departing from the scope of the invention. In addition, many modifications may be made to adapt a particular situation or material to the teachings of the invention without departing from the essential scope thereof. For instance, it is readily appreciated that other biasing means and engaging means can be employed in carrying out the preferred embodiment. Therefore, it is intended that the invention not be limited to the particular embodiments disclosed as the best mode contemplated for carrying out this invention, but that the invention will include all embodiments falling within the scope of the appended claims.

What is claimed is:

1. A pallet for printing on garments with sleeves and for supporting the sleeves to allow continuous printing on a central body portion of the garment and on the sleeves, said pallet comprising:

a lower panel for supporting the lower side of a garment during printing;

an upper panel mounted on the lower panel for insertion between upper and lower body plies of a garment and for supporting an upper ply of a garment during printing;

a pair of sleeve panels mounted to the upper panel for movement between a retracted position in which the sleeve panels are not extended for projection into garment sleeves, and an extended position in which the sleeve panels are projected into garment sleeves;

actuating means for shifting the upper panel and sleeve panels to a position spaced from the lower panel to allow a garment to be telescoped onto the upper panel and to be removed therefrom after printing;

biasing means for biasing the sleeve panels toward their extended position; and sleeve panel engaging means for engaging said sleeve panels in their retracted position to prevent the sleeve panels from moving to their extended position until disengaged from said engaging means whereupon the sleeve panels move automatically to their extended position into garment sleeves under the influence of said biasing means.

2. A pallet in accordance with claim 1 wherein said biasing means comprises a spring interconnecting said sleeve panels and said lower panel.

3. A pallet in accordance with claim 1 wherein said sleeve panel engaging means comprises cooperating engaging members on said sleeve panels and said upper panel.

4. A pallet in accordance with claim 1 wherein said sleeve panel engaging means includes a bracket mounted to the underside of the central body and a lip depending from the underside of the sleeve panels which lip engages with said bracket to hold the sleeve panel against sliding through the bracket.

5. A pallet for supporting shirts during printing thereupon, comprising:

a lower panel;

an upper panel having lateral sides and pivotally connected to the lower panel for movement between a raised position in which the upper panel is substantially spaced from the lower panel and a lowered position in which the upper panel rests upon the lower panel;

a pair of sleeve panels each pivotally connected to the upper panel for independent pivotal movement between a retracted position in which the sleeve panels are positioned between the lateral sides of the upper panel, and an extended position in which the sleeve panels extend beyond the lateral sides of the upper panel to provide support to the shirt sleeves during printing thereon;

biasing means for biasing said sleeve panels to their extended position; and selectively operable restraining means operable in a first position for restraining the sleeve panels in their retracted position and operable to a release position allowing the sleeve panels to move automatically to their extended position under the influence of the biasing means.

* * * * *

UNITED STATES PATENT AND TRADEMARK OFFICE

CERTIFICATE OF CORRECTION

PATENT NO. : 5,188,034

DATED : February 23, 1993

INVENTOR(S) : Iaccino, et al.

It is certified that error appears in the above-identified patent and that said Letters Patent is hereby corrected as shown below:

Column 1, line 55, change "principle" to --principal--.

Column 8, line 55, change "allow" to --allows--.

Column 10, line 22, change "slide" to --slides--.

Column 10, line 38, delete "the" (first occurrence).

Column 10, line 40, change "then" to --them--.

Column 12, line 2, change "FIG. 16." to --FIG. 16,--.

Column 14, line 18, change "move" to --moved--.

Column 14, line 27, change "26" to --226--.

IN THE CLAIMS:

Col. 14, line 50, change "central body" to --upper panel--

UNITED STATES PATENT AND TRADEMARK OFFICE

CERTIFICATE OF CORRECTION

PATENT NO. : 5,188,034

DATED : February 23, 1993

INVENTOR(S) : Iaccino, et al

It is certified that error appears in the above-identified patent and that said Letters Patent is hereby corrected as shown below:

Column 15, line 19, change "central body" to --upper panel--

Signed and Sealed this

First Day of March, 1994

Bruce Lehman

*Attest:*

BRUCE LEHMAN

*Attesting Officer*

*Commissioner of Patents and Trademarks*